US007172440B2

(12) United States Patent
Kanamaru

(10) Patent No.: US 7,172,440 B2
(45) Date of Patent: Feb. 6, 2007

(54) ELECTRIC CONNECTION BOX

(75) Inventor: Masahiro Kanamaru, Ogasa-gun (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/247,207

(22) Filed: Oct. 12, 2005

(65) Prior Publication Data

US 2006/0089020 A1 Apr. 27, 2006

(30) Foreign Application Priority Data

Oct. 25, 2004 (JP) ..... P2004-310113

(51) Int. Cl.
*H01R 13/44* (2006.01)

(52) U.S. Cl. ..... 439/135; 439/949

(58) Field of Classification Search ..... 439/76.2, 439/135, 136, 142, 718
See application file for complete search history.

(56) References Cited

U.S. PATENT DOCUMENTS 4,979,209 A * 12/1990 Collins et al. ..... 379/413.04
5,515,435 A * 5/1996 DeBalko et al. ..... 379/413.03
5,537,456 A * 7/1996 Bonvallat et al. ..... 379/27.01
5,623,542 A * 4/1997 Schneider et al. ..... 379/413.03
6,044,151 A * 3/2000 Wallace ..... 379/413.04
6,790,050 B1 * 9/2004 Roth-Stielow et al. ..... 439/76.2

FOREIGN PATENT DOCUMENTS

JP 2002-34122 A 1/2002

* cited by examiner

*Primary Examiner*—Tulsidas C. Patel
*Assistant Examiner*—Harshad C Patel
(74) *Attorney, Agent, or Firm*—Sughrue Mion, PLLC

(57) ABSTRACT

The interior of a case body is partitioned into two chambers by a partition wall, and the two chambers communicate with each other via a communication passage defined by a notch formed in the partition wall. First and second covers are attached to the case body, and cover open sides of the two chambers, respectively. The first and second covers have lap portions, respectively, which cover an open end of the communication passage in overlapping relation to each other.

3 Claims, 5 Drawing Sheets

ELECTRIC CONNECTION BOX

BACKGROUND OF THE INVENTION

1. Field of the Invention

This invention relates to an electric connection box which is mounted on an automobile or the like, and has a plurality of chambers formed within a case body.

2. Related Art

One conventional electric connection box of the type described is disclosed in JP-A-2002-34122, and is shown in FIG. 6. As shown in FIG. 6, this electric connection box 100 comprises a case 101 of a water-tight structure, and this case 101 comprises a case body 102 with an open top, and a cover 103 attached to the case body 102 to close the open top of the case body 102. The interior of the case body 102 is divided or partitioned by a partition wall 104 into two chambers 105 and 106.

The electric connection box 100 has the two chambers 105 and 106, and therefore has an advantage that parts can be received in the electric connection box separately from each other in an assorted manner.

In the above conventional electric connection box 100, however, the two chambers 105 and 106 within the case body 102 are closed by the single cover 103, and therefore the cover 103 has a large size. Therefore, when the electric connection box 100 is mounted in a narrow space such as an engine room, an operation for removing the cover 103 is, in some cases, very cumbersome.

It may be proposed to cover the chambers 105 and 106 with two covers, respectively. However, usually, a notch is formed in the partition wall 104 to provide a communication passage for the purpose of installing a wire harness. Therefore, when an attempt is merely made to close the open sides of the chambers 105 and 106 with the two covers, respectively, water is liable to intrude into the communication passage through a gap between the two covers, thus inviting a problem with respect to a waterproof performance.

SUMMARY OF THE INVENTION

This invention has been made in order to solve the above problems, and an object of the invention is to provide an electric connection box in which a cover can be easily removed even when the electric connection box is mounted in a narrow space, and besides the cover has an excellent waterproof performance.

(1) An electric connection box comprising:

a case body;

at least two chambers partitioned in the case body;

a notch defining a communication passage between adjacent two of the chambers formed on a partition wall partitioning the adjacent two chambers; and at least two covers attached to the case body so as to cover open surfaces of the adjacent two chambers;

wherein the covers have lap portions respectively, which cover an open surface of the communication passage such that the lap portions overlap to each other.

(2) First lap portion of the lap portions may include a projecting wall portion projecting from a peripheral edge portion of first cover of the adjacent two covers, and a groove portion formed on an inner edge of the projecting wall portion, and Second lap portion of the lap portions may include a covering portion covering the projecting wall portion, and a bent retaining portion which is bent at an outer edge of the covering portion so as to be received in the groove portion.

(3) The first cover comprises a frame-like cover frame which has an internal space opening to the open surface and on which the first lap portion is formed, and a cover body which is attached to said cover frame so as to close the internal space.

(4) The interior of the case body may be partitioned only into the two chambers by a single partition wall.

In the invention, the cover for covering an open side of the case body is divided into the sections (i.e., the plurality of covers), and therefore the covers can be easily removed even when an area or space available for removing the covers is narrow. The lap portions of the two covers cover the open end of the communication passage in overlapping relation to each other, and therefore water, deposited on outer surfaces of the covers, is prevented from intruding into the communication passage, so that an excellent waterproof performance is achieved.

In the invention, water which is scattered over the overlapping lap portions and the vicinity thereof enters the groove portion, and the water, thus entering the groove portion, is prevented by the projecting wall portion from flowing toward the peripheral edge portion. Therefore, this water flows through the groove portion, and drops from an end of this groove portion to the exterior. Therefore, water, deposited on the outer surfaces of the covers, is positively prevented from intruding into the communication passage.

In the invention, the cover, having the other lap portion, and the cover body of the cover, having the one lap portion, can be removed independently of each other, and therefore the two chambers can be made open separately or independently of each other. Therefore, when it is desired to make one of the chambers open, the desired chamber can be made open alone. This is convenient when effecting the maintenance and repair.

DETAILED DESCRIPTION OF THE PREFERRED EMBODIMENTS

One preferred embodiment of the present invention will now be described with reference to the drawings.

Figure 1:
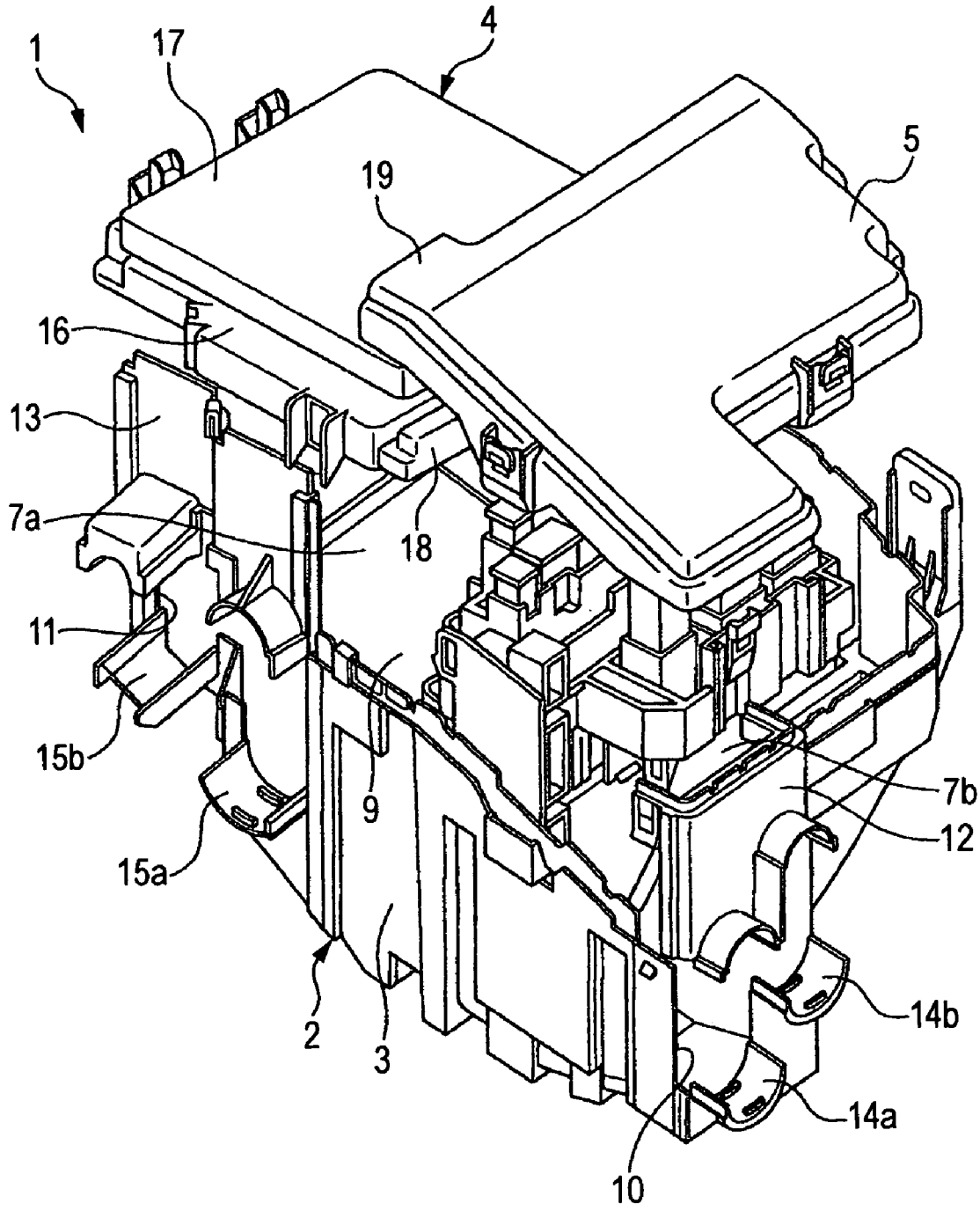
FIG. 1 is an exploded perspective view of one preferred embodiment of an electric connection box of the present invention.
Figure 2:
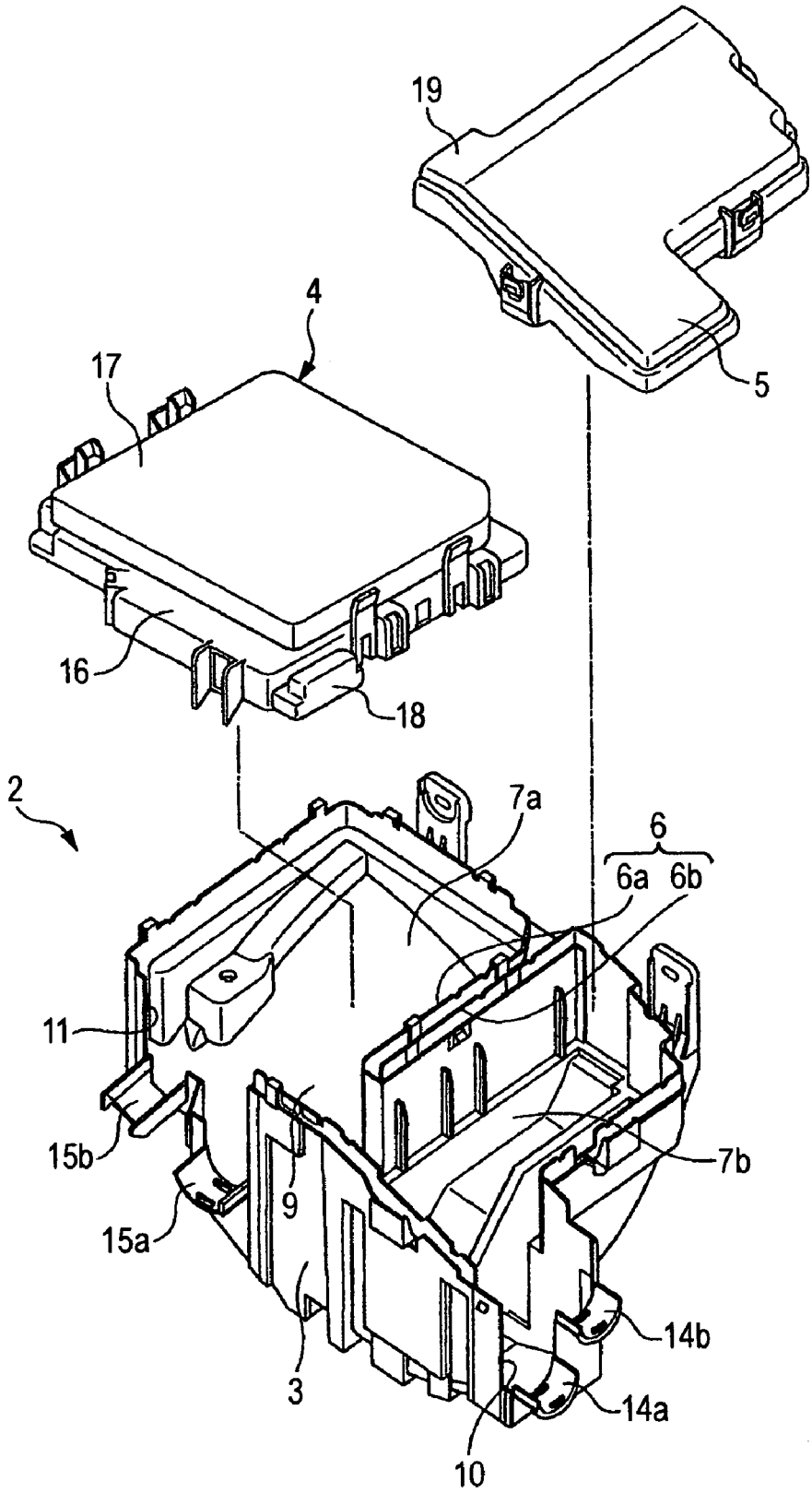
FIG. 2 is an exploded perspective view of a case of the above electric connection box.
Figure 3:
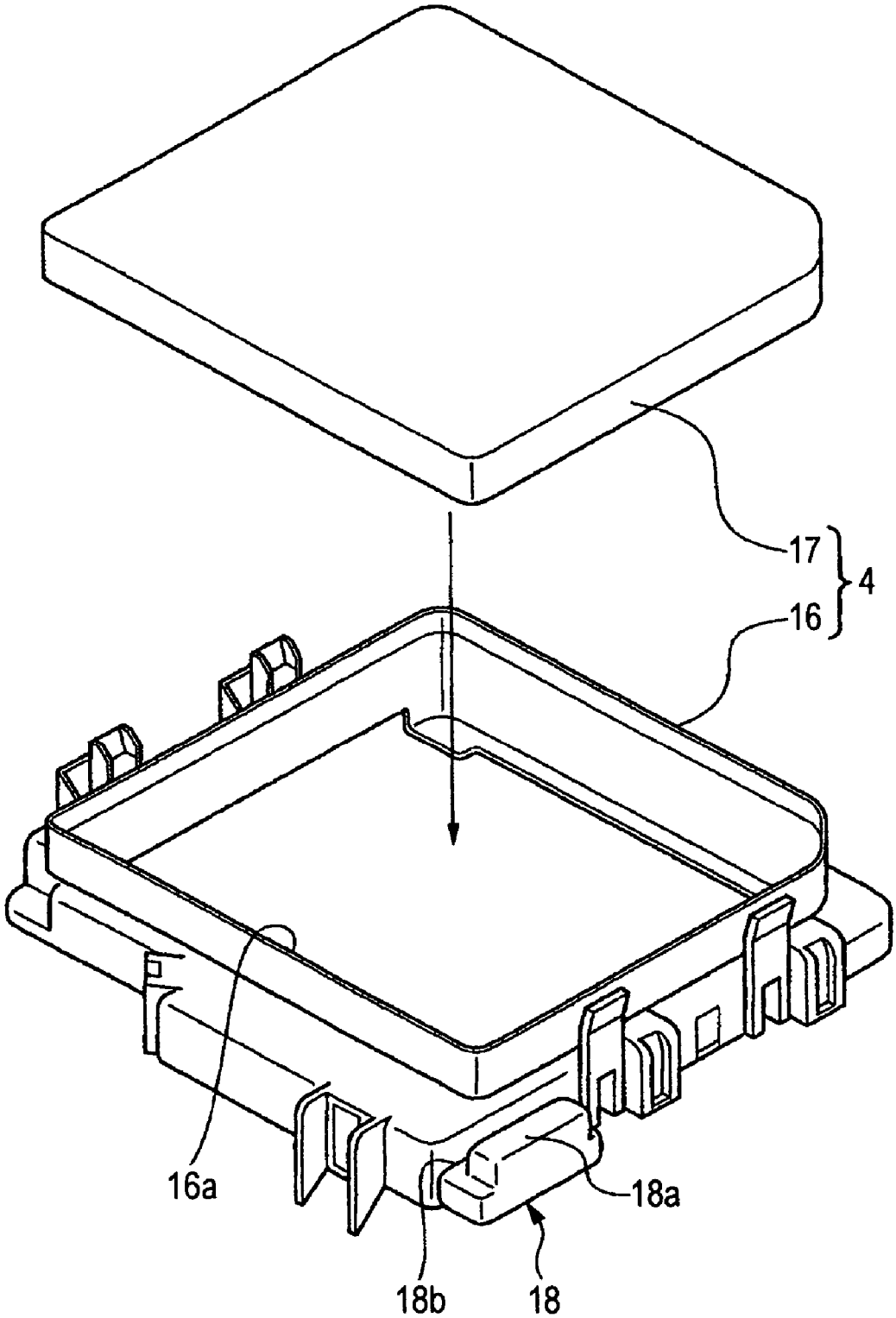
FIG. 3 is an exploded perspective view of a first cover of the electric connection box.
Figure 4:
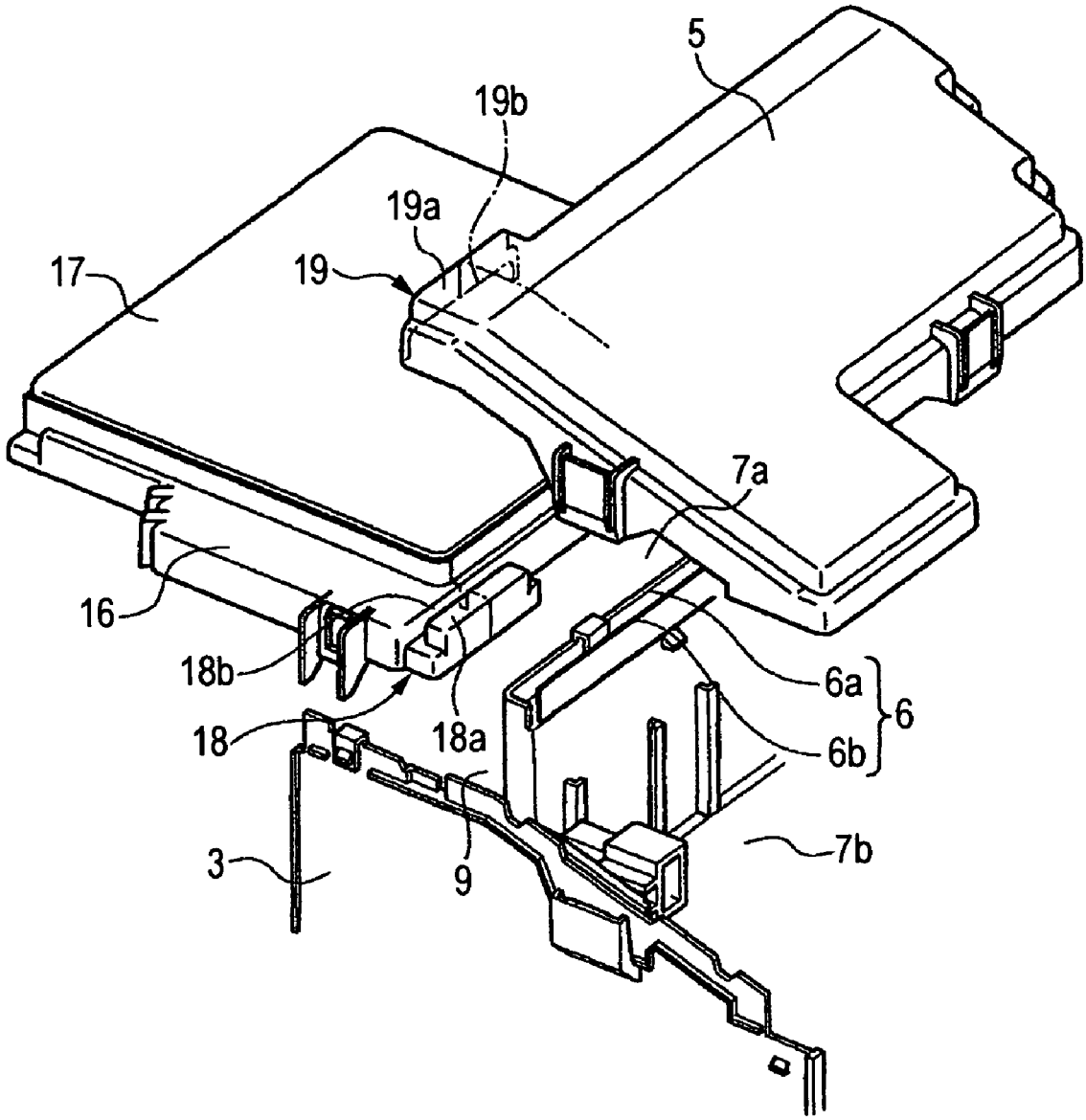
FIG. 4 is an exploded perspective view mainly showing two lap portions of the electric connection box.
Figure 5:
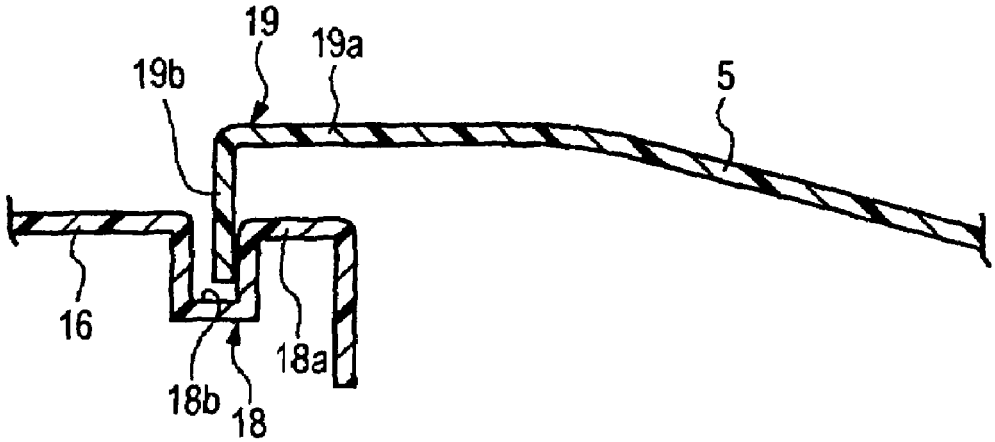
FIG. 5 is a cross-sectional view showing a condition in which the two lap portions overlap each other.
Figure 6:
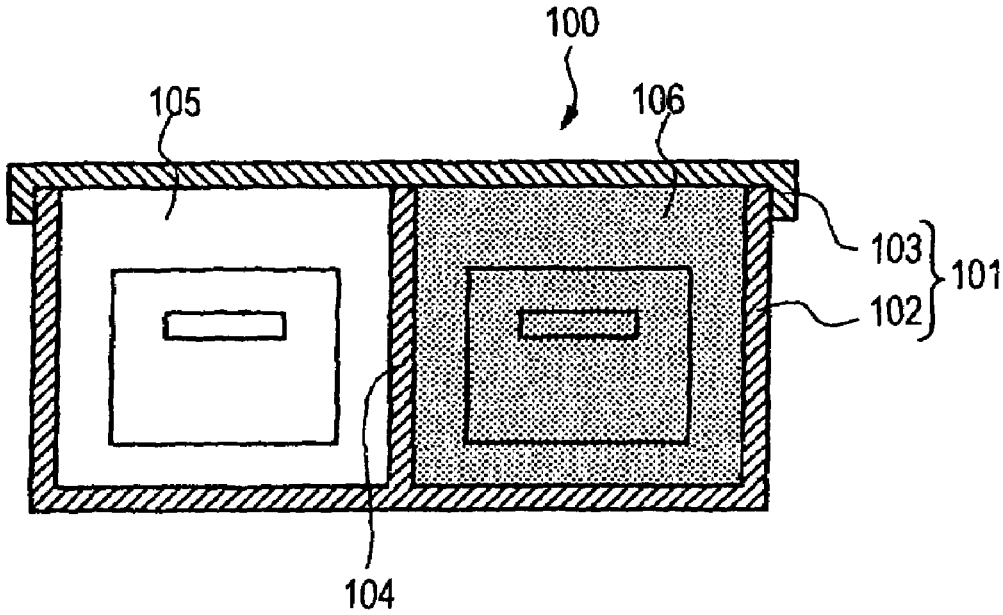
FIG. 6 PRIOR ART
FIG. 6 is a cross-sectional view of a conventional electric connection box.

FIGS. 1 to 5 show one preferred embodiment of the invention, and FIG. 1 is an exploded perspective view of an electric connection box 1, FIG. 2 is an exploded perspective view of a case 2, FIG. 3 is an exploded perspective view of a first cover 4, FIG. 4 is an exploded perspective view mainly showing two lap portions 18 and 19, and FIG. 5 is a cross-sectional view showing a condition in which the two lap portions 18 and 19 overlap each other.

As shown in FIGS. 1 and 2, the electric connection box 1 comprises the case 2 which is formed into a water-tight structure so as to prevent water from intruding into the case 2. The case 2 includes a case body 3 with an open top, and a cover attached to the case body 3 to close the open top of this case body 3, and this cover comprises the first cover 4, and a second cover 5.

A partition wall 6 is provided at a generally central portion of the interior of the case body 3 in an upstanding manner. This partition wall 6 has a double wall structure comprising two wall portions 6*a* and 6*b* spaced from each other with a very small gap formed therebetween. Water, intruding into the gap between the two wall portions 6*a* and 6*b*, is discharged to the exterior. The interior of the case body 3 is broadly divided or partitioned into two chambers 7*a* and 7*b* by the partition wall 6. Relay blocks (not shown) or the like are received in the two chambers 7*a* and 7*b*, respectively. The two chambers 7*a* and 7*b* communicate with each other via a communication passage 9 defined by a notch formed in the partition wall 6. Utilizing this communication passage 9, wire harnesses (not shown) are installed over a region including the two chambers 7*a* and 7*b*.

Two harness notch grooves 10 and 11 (which are open upwardly) are formed in a side wall of the case body 3. The wire harnesses (not shown) are passed through the harness notch grooves 10 and 11, and water stop covers 12 and 13 are slid from the upper side, and are attached respectively to the harness notch groove portions 10 and 11 through which the wire harnesses (not shown) pass. When the water stop covers 12 and 13 are thus attached, harness inlet/outlet ports 14*a*, 14*b*, 15*a* and 15*b* for the passage of the wire harnesses (not shown) therethrough are formed respectively by those portions of the harness notch grooves 10 and 11 which are not closed by the water stop covers 12 and 13. The harness inlet/outlet ports 14*a*, 14*b*, 15*a* and 15*b* are so sized as to correspond respectively to cross-sectional areas of the wire harnesses (not shown) (which are to be installed) so that water will not intrude through a gap between each of the harness inlet/outlet ports 14*a*, 14*b*, 15*a* and 15*b* and the corresponding wire harness (not shown).

As shown in FIGS. 1 and 2, the first cover 4 is attached to the case body 3 to completely close the open side of the chamber 7*a*. As shown in detail in FIG. 3, the first cover 4 comprises a cover frame 16 which is disposed in contiguous relation to an upper peripheral edge portion of the case body 3, and has an open internal space or opening 16*a* (shown in FIG. 3), and a cover body 17 which is attached to an upper side of the cover frame 16 to close the opening 16*a*. A peripheral edge portion of the cover frame 16 is disposed in overlapping relation to an outer surface of the outer peripheral edge portion of the case body 3 and an outer surface of the wall portion 6*a* of the partition wall 6 over an entire periphery thereof so that water, deposited on the upper surface of the cover frame 16, will drop outside of the case body 3 or drop into the gap between the two wall portions 6*a* and 6*b* of the partition wall 6.

As shown in detail in FIGS. 4 and 5, the lap portion 18 is formed on and projects from the cover frame 16 so as to cover an upper open end of the communication passage 9. As shown in FIGS. 4 and 5, this lap portion 18 includes a projecting wall portion 18*a* formed on and along and projecting from the peripheral edge portion of the cover frame 16, and a groove portion 18*b* formed on and along an inner edge of the projecting wall portion 18*a*. One end surface of the groove portion 18*b* is disposed outwardly of the outer peripheral wall of the case body 3, and the other end surface of the groove portion 18*b* is disposed on the partition wall 6.

The cover body 17 covers the cover frame 16 in overlapping relation to an outer surface of an inner peripheral edge portion of the cover frame 16 over an entire periphery thereof so that water, deposited on the upper surface of the cover body 17, will drop onto the cover frame 16.

As shown in FIGS. 1 and 2, the second cover 5 is attached to the case body 3 to completely cover the open side of the other chamber 7*b*. A peripheral edge portion of the second cover 5 is disposed in overlapping relation to the outer surface of the outer peripheral edge portion of the case body 3 and an outer surface of the wall portion 6*b* of the partition wall 6 over an entire periphery thereof so that water, deposited on the upper surface of the second cover 5, will drop outside of the case body 3 or drop into the gap between the two wall portions 6*a* and 6*b* of the partition wall 6.

As shown in detail in FIGS. 4 and 5, the lap portion 19 is formed on and projects from the second cover 5 so as to cover the upper open end of the communication passage 9. The lap portion 19 includes a covering portion 19*a* for covering the projecting wall portion 18*a*, and a bent retaining portion 19*b* which is bent downwardly at an outer edge of the covering portion 19*a* so as to be received in the groove portion 18*b*. Namely, the lap portions 18 and 19 of the first and second covers 4 and 5 cover the upper open end of the communication passage 9 in overlapping relation to each other.

In the above construction, when it is desired to make the whole of the interior of the case body 3 open, the second cover 5 is removed, and thereafter the first cover 4 (or the cover body 17 of the first cover 4) is removed. The first cover 4 (or the cover body 17) as well as the second cover 5 is sufficiently smaller as compared with the area of the opening (open top) of the case body 3, and therefore even when an area or space available for removing the first cover 4 (or the cover body 17) and the second cover 5 is narrow, these covers can be easily removed.

When it is desired to make only the chamber 7*a* open, only the cover body 17 of the first cover 4 is removed. When it is desired to make only the chamber 7*b* open, only the second cover 5 is removed. Thus, only the desired chamber 7*a* or 7*b* can be made open alone, and this is convenient when effecting the maintenance and repair.

The lap portions 18 and 19 of the first and second covers 4 and 5 cover the open end of the communication passage 9 in overlapping relation to each other, and therefore water is prevented from intruding into the communication passage 9 through a gap between the two lap portions 18 and 19, so that an excellent waterproof performance is achieved.

Particularly, the lap portion 18 includes the projecting wall portion 18*a* formed on and along and projecting from the peripheral edge portion of the cover frame 16, and the groove portion 18*b* formed on and along the inner edge of the projecting wall portion 18*a*, while the lap portion 19 includes the covering portion 19*a* covering the projecting wall portion 18*a*, and the bent retaining portion 19*b* which is bent at the outer edge of the covering portion 19*a*, and is received in the groove portion 18*b*. Therefore, water which is scattered over the lap portions 18 and 19 and the vicinity thereof enters the groove portion 18*b*, and the water, thus entering the groove portion 18*b*, is prevented by the projecting wall portion 18*a* from flowing toward the peripheral edge portion. Therefore, this water flows through the groove portion 18*b*, and drops from an end of this groove portion 18*b* to the exterior. Therefore, water is positively prevented from intruding into the communication passage 9 through the gap between the two lap portions 18 and 19.

In the above embodiment, the interior of the case body 3 is divided into the two chambers 7*a* and 7*b* by the partition wall 6. However, even in the case where the interior of the case body 3 is divided into three or more chambers by two or more partition walls 6, the invention can be applied in a generally similar manner.

What is claimed is:

1. An electric connection box comprising:

a case body;

at least two chambers partitioned in said case body;

a notch defining a communication passage between adjacent two of said chambers formed on a partition wall partitioning said adjacent two chambers; and first and second covers attached to said case body so as to cover open surfaces of said adjacent two chambers;

wherein said first and second covers have lap portions respectively, which cover an open surface of said communication passage such that said lap portions overlap each other above said communication passage, wherein a first lap portion of said lap portions includes a projecting wall portion projecting from a peripheral edge portion of said first cover, and a bottomed groove portion formed on an inner edge of said projecting wall portion acting as a gutter for conveying water to an exterior of the chambers, and a second lap portion of said lap portions includes a covering portion covering said projecting wall portion, and a bent retaining portion which is bent at an outer edge of said covering portion so as to be received in said groove portion.

2. An electric connection box according to claim 1, wherein said first cover comprises a frame-like cover frame which has an internal space opening to the open surface and on which said first lap portion is formed, and a cover body which is attached to said cover frame so as to close the internal space.

3. An electric connection box according to claim 1, wherein an interior of said case body is partitioned only into said two chambers by a single partition wall.

* * * * *